United States Patent [19]

Takagi et al.

[11] 4,236,540

[45] Dec. 2, 1980

[54] PLIABLE AND RESTORABLE HAIRSETTER

[75] Inventors: Shoji Takagi, Toyoake; Nobuo Ito, Nagoya, both of Japan

[73] Assignee: Tokyo Shibaura Electric Co., Ltd., Kawasaki, Japan

[21] Appl. No.: 31,965

[22] Filed: Apr. 20, 1979

Related U.S. Application Data

[63] Continuation-in-part of Ser. No. 808,386, Jun. 20, 1977, abandoned.

[30] Foreign Application Priority Data

Jul. 5, 1976 [JP] Japan ..... 51-89648[U]

[51] Int. Cl.[2] ..... A45D 2/00

[52] U.S. Cl. ..... 132/40; 132/33 R

[58] Field of Search ..... 132/33 R, 36, 39, 40, 132/42

[56] References Cited

U.S. PATENT DOCUMENTS

| | | | |
|---|---|---|---|
| Re. 26,766 | 1/1970 | Jorgensen | 132/33 R |
| 2,742,046 | 4/1956 | Jurewicz | 132/33 R |
| 3,473,004 | 10/1969 | Block et al. | 132/33 R |
| 3,585,357 | 6/1971 | Mandell | 132/33 R |
| 3,610,878 | 10/1971 | Thomas | 132/33 R |
| 3,814,113 | 6/1974 | Morane | 132/36 R |

*Primary Examiner*—G. E. McNeill

*Attorney, Agent, or Firm*—Cushman, Darby & Cushman

[57] ABSTRACT

A home hair-setter whose body is a cylindrical heat-resistant elastic member and wherein the outer peripheral surface of the body of the hair-setter is used to curl hair; the hair-curling section of the body is enclosed in a cylindrical envelope; and the body of the hair-setter has at least one of its both ends left open.

9 Claims, 10 Drawing Figures

PLIABLE AND RESTORABLE HAIRSETTER

CROSS-REFERENCE TO THE RELATED APPLICATION

This is a continuation-in-part application of U.S. pat. application Ser. No. 808,386 filed June 20, 1977 now abandoned.

BACKGROUND OF THE INVENTION

This invention relates to improvements on a home hairsetter which is designed to set hair wound about its body heated by heating means. Prior art home hairsetter set forth in the British Pat. No. 1,140,369, and the utility models 3303/1969, 3304/1969, 15,868/69, 14,017/1970, 843/1972, 14,133/1974, 45,886/1974 and 13,067/1949 all published in Japan include the type wherein the body of a hairsetter comprises an inner cylinder made of a material having a high regenerating capacity and an outer cylinder made of hard plastics material and attached on the outer periphery thereof or the type wherein the body of a hairsetter comprises an inner cylinder containing an inner cylinder of regenerating material such as paraffin and an outer cylinder made of hard plastics material. These known home hairsetter have the advantage that they are available for use when heated by proper heating means and can thermally set hair in a short time. Therefore, the above-mentioned type of home hairsetter is now widely accepted, because it can curl hair more quickly than the so-called net type hairsetter particularly heat means in the morning when the user is generally hard pressed for time. However, the conventional home hairsetter whose body is made of solid material has the drawbacks that when the user sleeps with her hair wound about the hairsetter body, said body is roughly pressed against her head, causing her to feel a pain and in extreme cases, injures the skin of her head; consequently the use of such home hairsetter has been limited to any other time of the day than the bedtime; and it is impossible firmly to set hair by operating said hairsetter for long hours while she is asleep. In other words, the conventional home hairsetter does not admit of application of the best hairsetting process, that is, the process of winding hair about the heated body of a home hairsetter and removing the hair from the body after it is naturally cooled, and inconsequence fails to impart a lasting curl to the hair. Particularly, the prior art regenerator type home hairsetter is accompanied with the difficulties that the cylindrical hairsetter body containing a regenerating agent such as paraffin is built airtight to prevent the leakage of molten paraffin, giving rise to the possibility of the hairsetter body exploding should abnormal heating occur; and for this reason a complicated construction is required to avoid the explosion of the hairsetter body.

SUMMARY OF THE INVENTION

This invention has been accomplished in view of the above-mentioned circumstances and is intended to provide a home hairsetter whose body is made of a heat-resistant elastic material, and which enable the user to sleep with her hair wound about said body and can be applied safely for any length of time.

Another object of the invention is to provide a home hairsetter whose body is formed of a heat-resistant elastic material, wherein the elasticity of the hairsetter body causes the outer peripheral surface of a heating rod to be tightly pressed against the inner wall of the hairsetter body, thereby elevating heat conduction and inconsequence reducing heating time; and moreover the heating rod can be easily inserted into, and drawn out of, the hairsetter body.

BRIEF DESCRIPTION OF THE DRAWING

FIG. 3 (*b*) is an oblique view of a hairpin for supporting the hair wound about the hair-curling section of the hairsetter body;

FIG. 6 (*a*) is a longitudinal sectional view of the body of said home hairsetter and FIG. 6 (*b*) is a longitudinal sectional view showing a heating rod inserted into said body; FIG. 7 (*a*) is a longitudinal sectional view of the body of a home hairsetter embodying the invention; and FIG. 7 (*b*) is a longitudinal sectional view of a heating rod inserted into said body.

DETAILED DESCRIPTION OF THE PREFERRED EMBODIMENTS

Figure 1:
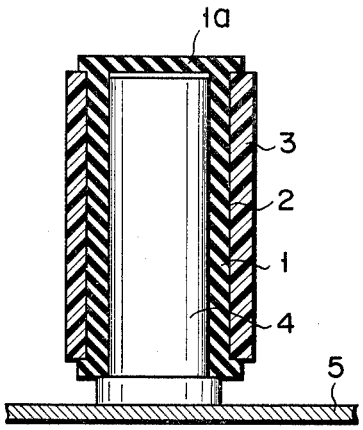
FIG. 1 is a longitudinal sectional view showing a heating rod inserted into the body of a home hairsetter according to a first embodiment of this invention.

There will now be described by reference to FIG. 1 a home hairsetter according to a first embodiment of this invention. Referential numeral 1 denotes a hollow cylindrical body of a home hairsetter integrally formed of a heat-resistant elastic material. One end of the body is left open, and the other end thereof is closed by the end plate la.

The heat-resistant elastic material may consist of silicon rubber and contains, for example, ethylene propylene rubber or perfume as an auxiliary component. The physical property of the heat-resistant elastic material is as follows: hardness: 50° tensile strength: 81 kg/cm$^2$, elongation: 310%, density: 1.16, heat resistance: 200° C., tear strength: 20 kg/cm, wherein for determining a rubber hardness, a pushing rod connected to a spring is applied to the center of a test piece so as to depress the central portion of the test piece. Then, the peripheral portion of the test piece is pressurized so as to push back the pushing rod against the spring force. The rubber hardness is represented by the pushed back distance of the pushing rod. And, $$\text{Tear strength} = \frac{\text{Maximum Load (kg)}}{\text{Thickness (cm) of Tested Portion of Test piece}}$$

Referential numeral 2 shows the hair-curling section of the hairsetter body 1 for curling hair wound thereabout. This hair-curling section is constituted by the outer peripheral surface of the curler body. Referential numeral 3 indicates an envelope closely fitted to the hair-curling peripheral surface of the hairsetter body. This envelope 3 is formed of pliant spongy porous material, for example, synthetic resin foam like soft polyurethane resin foam. Referential numeral 4 is a heating rod partly constituting a heating apparatus. A plurality of said heating rods are projectively mounted on a heating plate 5 provided with an electric heater (not shown). For briefness of representation, FIG. 1 shows only one of said heating rods 4.

There will now be described the operation of a home hairsetter embodying this invention. When the heating rod 4 is inserted into the hollow cylindrical hairsetter body 1 to supply power to the heating plate 5, then the hairsetter body 1 is heated by the heating rod 4. When the hairsetter body 1 is heated to a prescribed level of temperature, then the heating rod 4 is pulled out of the cylindrical hairsetter body 1. At this time the user winds her hair being set about the hair-curling section 2 of the hairsetter body 1.

According to the first embodiment of this invention, the hairsetter body 1 is made of an elastic material. When , therefore, the user sleeps with her hair wound about the hair-curling section 2 of the hairsetter body 1, there is little possibility of the hairsetter body 1 being roughly pressed against the head of the user to cause her to feel a pain, or injure the skin of her head. Since the user can sleep with her hair wound about the hairsetter body, her hair can be effectively set by the heating of the hairsetter body. Further since the user's hair remains wound about the hairsetter body for a long period of time which lies between the point of time at which the hairsetter body gets cooled and the rising time of the user, her hair can be set more firmly. Therefore, it is possible to impart lasting curls to the user's hair, thereby keeping the hair in shape for long hours.

According to the foregoing embodiment, the hair-curling outer peripheral surface 2 of the hairsetter body 1 which is enclosed in a pliable envelope 3 more softly touches the head of the user when she sleeps with her hair wound about the hairsetter body 1, rendering her sleep more comfortable.

When the heating rod 4 is pulled out of the hairsetter body 1, the heating-insulating effect of the air cells of the envelope 3 made of, for example, foamed material prevents the user from feeling hot even directly grasping the envelope 3 by her hand. Where the user's hair is wound about the hairsetter body 1, namely, the envelope 3, then the air cells of the envelope 3 are crushed by the force with which the user's hair is wound, thereby attaining better heat transfer from the hairsetter body 1 to the hair. Further, the user's hair can be more easily wound about the hairsetter body 1, because the hair is brought to a state caught by the air cells lying on the outer peripheral surface of the envelope 3. Where the envelope 3 is previously filled with some amount of water, the user's hair is heated while being wetted to be more effectively set and consequently is prevented from being damaged due to excessive drying.

The pliable envelope 3 about which the user's hair is wound need not be made of soft synthetic resin foam, but may be formed of cloth or piled cloth. Further, it is possible to implant short fibers directly in the hair curling outer peripheral surface 2 of the hairsetter body 1.

Figure 2:
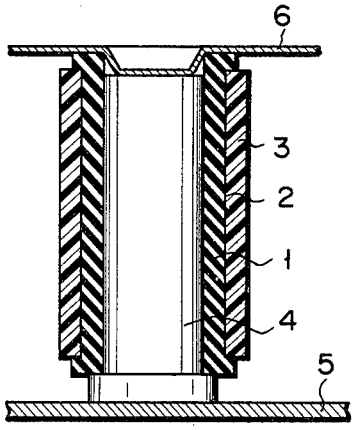
FIG. 2 is a longitudinal sectional view showing a heating rod inserted into the body of a home hairsetter according to a second embodiment of the invention.
Figure 3A:
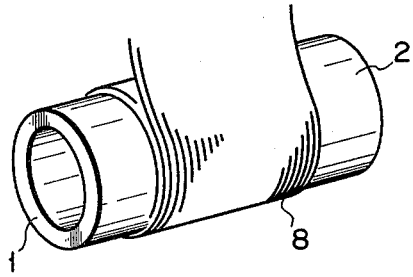
FIG. 3 (*a*) is an oblique view showing hair wound about the hair-curling section of the hairsetter body.
Figure 3B:
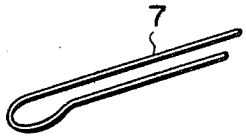

FIG. 2 shows a home hairsetter according to a second embodiment of this invention. The part of FIG. 2 the same as those of FIG. 1 are denoted by the same numerals. Description is only given of those parts of FIG. 2 which are different from those of FIG. 1. Referring to FIG. 2, the hollow cylindrical home hairsetter body 1 is open at both ends. One of the openings of the hairsetter body is provided with a detachable heat-insulating board 6 to prevent the interior heat of the hairsetter body from being released from said opening.

Where the hairsetter body 1 has its both ends left open, mechanical strength is uniformly distributed through the various sections lying between both openings, thus offering the advantage that when the user sleeps with her hair wound about the hairsetter body 1, her head does not feel unpleasant rough touches which might otherwise occur at the closed end plate 1*a* (FIG. 1) due to uneven stresses being applied to both end portions of the hairsetter body 1.

Further advantage of the hairsetter body 1 representing the second embodiment of FIG. 2 is that where the user sleeps with the hairsetter body 1 placed under her head, the uniform distribution of mechanical strength throughout the hairsetter body 1 and inconsequence application of equal stresses thereto prevent her hair wound about the hair-curling section from being set with different forces.

The hollow hairsetter body 1 according to said second embodiment is not subject to limitations on the direction in which it is applied, making it possible readily to insert a heating rod into the hollow hairsetter body and also easily to support the user's hair 8 on the hairsetter body 1, for example, by a hairpin 7, after the hair 8 is wound about the hairsetter body 1.

Figure 4:
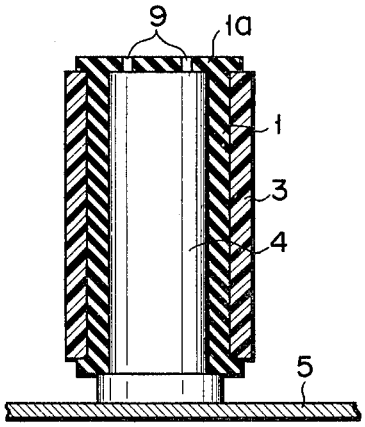
FIG. 4 is a longitudinal sectional view showing a heating rod inserted into the body of a home hairsetter according to a third embodiment of the invention.

FIG. 4 illustrates a home hair curler according to a third embodiment of this invention. According to this embodiment, the end plate 1a of the hairsetter body 1 is provided with at least one slit 9. This slit 9 acts as an air exhaust for preventing a space lying between one end of the heating rod 4 and the closed end of the hairsetter body 1 from being unduly pressurized. Though the air exhaust 9 is formed in the end plate 1a of the hairsetter body 1 as shown in FIG. 4, yet said air exhaust 9 may be provided in the form of a groove lengthwise extending along the peripheral surface of the heating rod 4.

Figure 5:
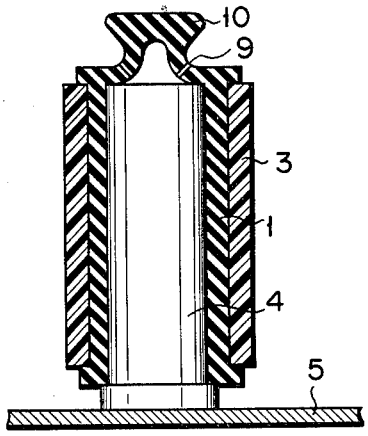
FIG. 5 is a longitudinal sectional view of the body of a home hairsetter fitted with a knob projecting out of a sealing member.

With the home hairsetter according to the first and third embodiments, the end plate 1*a* closing one end of the hairsetter body 1 may be provided with a knob 10 projecting outward from said end plate 1*a*, as shown in FIG. 5. This knob 10 enables the heating rod 4 to be easily pulled out of the hairsetter body 1.

Further, the elastic material consituting the hairsetter body 1 according to the first, second and third embodiments may be impregnated with, for example, fine powders of aluminium as good heat conductor. Inclusion of fine aluminium powders in the elastic material has the advantages that the heat conductivity of the hairsetter body 1 as a whole is elevated; the time of heating by the heating rod 4 is shortened; and the hair 8 is quickly and effectively heated, thereby increasing the force with which the hair 8 is set.

There will now be described by reference to FIG. 6 another arrangement for heating a home hairsetter embodying this invention. Referential numeral 20 denotes a hairsetter body. As in the preceding embodiments, the hairsetter body 20 is a cylindrical heat-resistant elastic member. The outer peripheral surface of the cylindrical hairsetter body 20 constitutes a hair-curling section 21, which in turn is enclosed in a pliant spongy envelope 22. Referential numeral 23 shows a columnar metal heating rod, which is projectively provided on a heating board 25 fitted with an electric heater 24. The hairsetter body 20 has an inner diameter A substantially the same as, or slightly smaller than, the outer diameter B of the heating rod 23. Where the inner diameter A of the hairsetter body 20 and the outer diameter B of the heating rod 23 have the above-mentioned measurements, then it is preferred that the inner walls of the cylindrical hairsetter body 20 be tapered near both ends for easy insertion of the heating rod 23.

When power is supplied to the electric heater 24 of the heating board 25 with the heating rod 23 inserted into the hairsetter body 20, then the hair curler body 20 is heated by the heating rod 23. After the hairsetter body 20 is heated to a prescribed level of temperature, the heating rod 23 is pulled out of the hairsetter body 20, and then the user's hair 8 is wound about the hair-curling section 2 (FIGS. 1 and 2) of the hairsetter body 20 to be set.

Figure 6A:
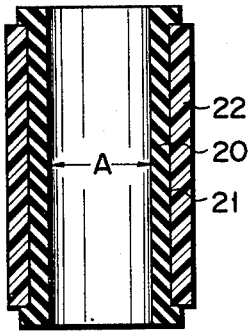
FIG. 6 shows a first process of heating the body of a home hairsetter embodying the invention.
Figure 6B:
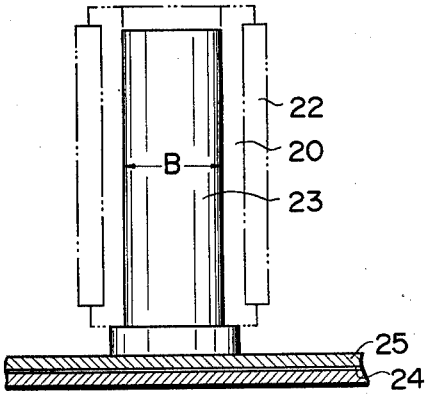

Since, with the embodiment of FIG. 6, the hairsetter body 20 is made of an elastic material, and has its inner diameter A made substantially equal to, or sightly smaller than, the outer diameter B of the heating rod 23, the whole inner peripheral wall of the hairsetter body 20 is made by its elastic force closely to abut against the outer peripheral surface of the heating rod 23, attaining effective heat conduction from the heating rod 23 to the hairsetter body 20 and in consequence reducing required heating time. Moreover, the elastic and freely deformable hairsetter body 20 enables the heating rod 23 to be easily inserted into, and pulled out of, the hairsetter body 20.

Figure 7A:
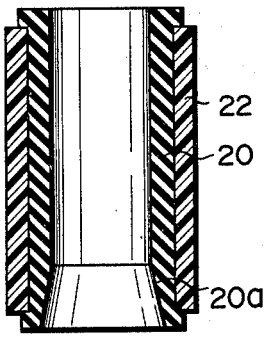
FIG. 7 shows another process of heating the body of a home hairsetter embodying the invention.
Figure 7B:
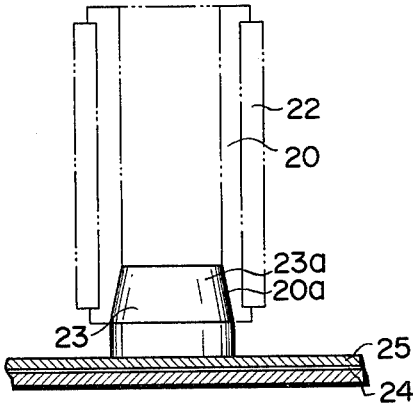

There will now be described by reference to FIG. 7 still another arrangement for heating a home hairsetter. As seen from FIG. 7, the heating rod 23 is made slightly shorter than that of FIG. 6. Either half portion 23*a* of said heating rod 23 is made into a round truncated conical form. The inner peripheral wall of one end portion 20*a* of the hairsetter body 20 is tapered to conform to the truncated conical form of the aforesaid half portion 23*a* of the heating rod 23. When the hairsetter body 20 is heated, it is advised to insert the truncated conical half portion 23*a* of the heating rod 23 into the tapered portion formed on the inner peripheral wall of one end 20*a* of the hairsetter body 20. At this time, said inner peripheral wall of the hairsetter body 20 is tightly pressed against the truncated conical half portion 23*a* of the heating rod 23 due to the elasticity of the hairsetter body 20. The above-mentioned arrangement enables the heating rod 23 to be more easily inserted into, and pulled out of, the hairsetter body 20.

This invention is not limited to the foregoing embodiments described by reference to the appended drawings, but may be applicable in various modifications without changing the object of the invention.

As previously mentioned, the body of the home hairsetter embodying this invention is made of a heat-resistant elastic material and adapted to be heated by proper means. Therefore, the home hairsetter of the invention has the advantages that the user can curl her hair quickly particularly in the morning when she goes to work; when she sleeps with her hair wound about the hairsetter body, she does not feel any pain and the skin of her head is little likely to be injured; it is possible to adopt the best hair-curling process, that is, the process of winding the user's hair about the hairsetter body when heated and removing her hair after the hairsetter body is naturally cooled; the firmer and more lasting curls can be imparted to the user's hair then is possible with the prior art home hairsetter due to a synergetic effect derived from thermal setting and long time winding of hair; and the present home hairsetter can be applied at any time of the day without limitation of the length of time for which said hairsetter is used.

Further, the head load differs for a different set position of hairsetter, but the head load is normally 6–10 kg at maximum, whereas according to this invention the force needed to flatten the hairsetter body is about 2 kg thus, the hairsetter body of the present invention is completely flattened by the 6–10 kg force exerted by the user's head.

The home hair setter of this invention displays the following advantageous effects.

(1) The conventional net type home hairsetter has the drawback that when the user sleeps with her washed hair kept wet, for example, in winter time, her head is unpleasantly cooled. But the home hairsetter of this invention eliminates such drawback, because the user's hair is wound about the heated hairsetter body.

(2) When the user's hair is wound about the hairsetter body of this invention, its elastic deformation enables the user's hair to be more closely attached to the hair-curling section of the hairsetter body, admitting of the easier winding and more effective setting of hair.

(3) Even if abnormally heated, the present home hairsetter is more reliably saved from the danger of explosion than the customary home hairsetter whose body is impregnated with a regenerating agent such as paraffin, eliminating the necessity of providing an explosion-proof construction and in consequence realizing a very simple arrangement.

(4) When soiled by long use, the present home hairsetter can be easily washed, for example, by a washing machine, because the hairsetter body is made of an elastic material. Moreover, said body has a heat-resistant property and admits of sterilizing washing by boiling and can be always kept sanitary. Further the subject home hairsetter is adapted for use as an implement for hair dressing and beauty culture.

(5) The hairsetter body enclosed in a porous pliant envelope gently touches the head of the user when she sleeps with her hair wound about the hairsetter body, thereby enabling her to sleep comfortably.

When a heating rod is pulled out of the hairsetter body, the heat-insulating effect of the air cells of the porous envelope prevents the user from feeling hot when she directly grasps the hairsetter body by hand. When the hair is wound about the hairsetter body, the air cells of the porous envelope of the hairsetter body are crushed by the force with which the hair is wound, attaining better heat transfer from the hairsetter body to the hair. Further, the hair is easily wound about the hairsetter body because the hair is brought to a state caught by the air cells formed on the outer peripheral surface of the porous envelope. When the porous envelope is filled with some amount of water, the hair is heated while being wetted, increasing the force with which the hair is set and effectively eliminating the drawback of damaging the hair due to its excessive drying.

(6) The hairsetter body formed of an elastic material mainly consisting of silicon rubber has prominent heat resistance, elasticity and righting moment; when heated, little evolves unpleasant odors characteristic of synthetic rubbers; and moreover is possessed of excellent colorability and gloss.

(7) The hairsetter body impregnated, if necessary, with fine powders of aluminium acting as good conductor is prominently improved in heat conductivity as a whole; decreases the time of heating by the heating rod; and enables the hair to be quickly and effectively heated for setting, thereby increasing the force with which the hair is set.

(8) Close abutment of the hairsetter body against the heating rod increases heat transfer and shortens heating time. (9) A knob fitted to one end of the hairsetter body enables the heating rod to be easily inserted into, and pulled out of, the hairsetter body.

What we claim is:

1. A home hairsetter comprising:

a hollow cylindrical body having a hair-curling section on the outer periphery; and a heating apparatus adapted to be fitted into the cylindrical body for heating the cylindrical body, said heating apparatus being removed from the cylindrical body while said body is used to set hair;

said body being made of elastic material including silicon rubber and being restorable, and being so pliable that when used to set hair with a head load exerted thereon which is more approximately 2 kg, said body flattens so that it gently touches the user's head when the user's head is in a prone position.

2. The home hairsetter according to claim 1, which comprises a closing member for shutting up at least one of both openings of the hair curler body.

3. The home hairsetter according to claim 2, wherein the closing member has at least one air-releasing slit.

4. The home hairsetter according to claim 3, wherein the closing member has a knob projecting outward therefrom.

5. The home hairsetter according to claim 1, which comprises a pliant envelope enclosing the hair-curling section of the hair curler body to allow hair to be wound thereabout.

6. The home hairsetter according to claim 1, wherein the curler body is impregnated with fine powders of good conductor.

7. The home hairsetter according to claim 1, wherein the heating apparatus constituted a heating rod, the outer peripheral surface of the heating rod closely abutting against the inner peripheral wall of the hair curler body.

8. The home hairsetter according to claim 7, wherein the outer peripheral surface of the heating rod has a larger diameter than that of the inner peripheral wall of the hair curler body.

9. The home hairsetter according to claim 7, wherein one half portion of the heating rod is made into a round truncated conical form, and that portion of the hair curler body which faces said one half portion of the heating rod is so tapered as to conform to said round truncated conical form.

* * * * *